United States Patent [19]

Sakata

[11] Patent Number: 4,840,151

[45] Date of Patent: Jun. 20, 1989

[54] SEALED-TYPE LASH ADJUSTER

[75] Inventor: Masayasu Sakata, Niiza, Japan

[73] Assignee: Honda Giken Kogyo Kabushiki Kaisha, Tokyo, Japan

[21] Appl. No.: 61,867

[22] Filed: Jun. 11, 1987

[30] Foreign Application Priority Data

Jun. 14, 1986 [JP] Japan ..... 61-138711

[51] Int. Cl.[4] ..... F01L 1/24

[52] U.S. Cl. ..... 123/90.43; 123/90.58; 123/90.46

[58] Field of Search ..... 123/90.58, 90.43, 90.46, 123/90.59

[56] References Cited

U.S. PATENT DOCUMENTS

| | | | |
|---|---|---|---|
| 2,833,257 | 5/1958 | Lengnick | 123/90.58 |
| 3,170,446 | 2/1965 | Dolza | 123/90.43 |
| 4,656,978 | 4/1987 | Deuring | 123/90.58 |
| 4,739,734 | 4/1988 | Honda et al. | 123/90.43 X |

FOREIGN PATENT DOCUMENTS

| | | | |
|---|---|---|---|
| 0504132 | 7/1954 | Canada | 123/90.58 |
| 0098608 | 7/1980 | Japan | 123/90.43 |

*Primary Examiner*—Willis R. Wolfe

*Attorney, Agent, or Firm*—Lahive & Cockfield

[57] ABSTRACT

A sealed-type lash adjuster includes a cylindrical body; a plunger received in the body and forming a chamber with the bottom of the body; and a diaphragm mounted between an open end of the body and the plunger, and forming a reservoir for hydraulic oil to be supplied to the chamber. The adjuster also includes a holder having a bushing for receiving the body with the bottom of the body engageable with a valve rocker, and the diaphragm and the open end of the body generally facing away from the combustion chamber, a reservoir for storing fluid lubricant, and a conduit for conducting fluid lubricant from the reservoir to an interior annular channel in the bushing. At least part of the thickness of the diaphragm is formed of a fluorine-bonded layer extending over the entirety of the diaphragm.

1 Claim, 3 Drawing Sheets

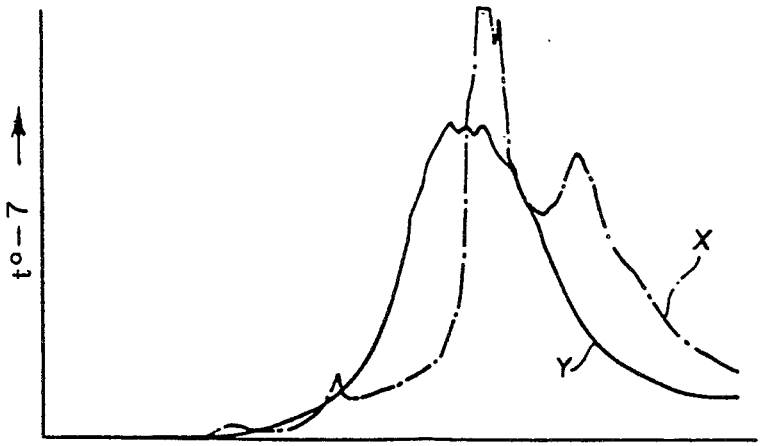
FIG. 2
FIG. 3 (A)
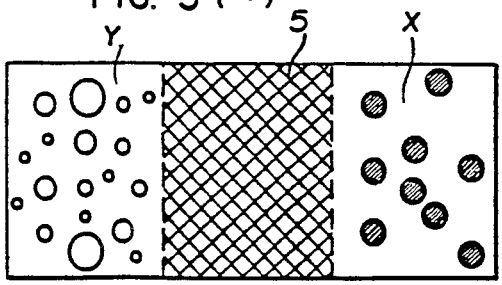
NORMAL TEMPERATURE
FIG. 3 (B)
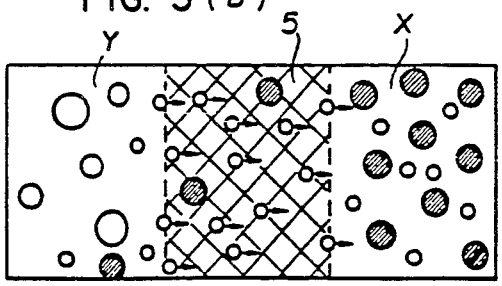
135°

SEALED-TYPE LASH ADJUSTER

GENERAL NATURE AND SUMMARY OF INVENTION

The present invention relates to a sealed-type lash adjuster, and more particularly, to a sealed-type lash adjuster suitable for use in valve systems of internal combustion engines.

This invention involves a sealed-type lash adjuster comprising cylindrical body mans having a bottom and plunger means slidably received in this body means and forming a high pressure chamber for sealing hydraulic oil between an inner surface of the bottom portion of the body mans and the plunger means. The diaphragm means is mounted between an open end of said body mans and said plunger means and forms a reservoir chamber for the hydraulic oil to be supplied to said high pressure chamber.

In this invention, this diaphgragm means is formed of flexible material, with at least part of the thickness thereof being formed of a fluorine-bonded layer extending over the entirety of said diaphragm means.

In describing this invention, reference will made by way of example but not limitation, to preferred embodiments and prior art shown in drawings appended hereto.

DESCRIPTION OF PREFERRED EMBODIMENT IN RELATION TO CERTAIN KNOWN PRIOR ART

It is known, with respect to the valve systems of internal combustion engines, to keep the gap between a valve body and a cam which opens and closes the valve body to zero by means of a lash adjuster. One example of such a lash adjuster will be described hereinunder by referring to FIG. 1.

A lash adjuster 1 comprises a cylindrical body 2 having a bottom, a plunger 3 slideably received in the body 2 so as to form a high pressure chamber A filled with hydraulic oil. This chamber A is located between the inner surface of the bottom portion of the body 2 and the plunger 3. A plunger spring 4 is disposed between the plunger 3 and the body 2 for urging the plunger 3 in its protruding direction, i.e. out of its cavity. A flexible diaphragm 5 is mounted on the open end of the body 2 and the plunger 3 and forms a reservoir chamber B for the hydraulic oil to be supplied to the high pressure chamber A. A check valve 6 is incorporated in the high pressure chamber A for preventing the hydraulic oil from flowing into the reservoir chamber B from the high pressure chamber A. The lash adjuster of this type is referred to as a sealed-type, lash adjuster.

As shown in FIG. 4, the lash adjuster 1 is mounted on the rocking center of a rocker arm extending between an actuating cam and the valve body. This lash adjuster is adapted to eliminate any gap formed between the rocker arm and the valve body or the cam by protrusion of the plunger 3 out of the body 2 by means of the plunger spring 4, thereby moving the rocker arm to engage the valve body or the cam. The spring 4 also prevents the plunger 3 from collapsing into the body 2. The aforementioned gap is kept at zero by supplying hydraulic oil from the reservoir chamber B to the high pressure chamber A via a check valve 6 on the basis of the relative movement of the body 2 and the plunger 3 and by sealing the supplied hydraulic oil in the high pressure chamber A by means of this check valve 6. In addition, changes in volume of the reservoir chamber B caused by the hydraulic oil flowing out are absorbed by the flexible diaphragm.

In the sealed-type, lash adjuster of the above construction, since the diaphragm 5, which in part closes and forms the reservoir chamber b, must suitably allow for changes in the volume of the reservoir chamber B and the relative movement of the body 2 and the plunger 3, it is formed of a flexible material, such as silicone rubber. The inner surface of the diaphragm is made to be in contact with the hydraulic oil, while the outer surface is exposed to the atmosphere. As a result, atmosphere air permeates through the diaphragm 5 into the reservoir chamber B, thereby causing the volume of the reservoir chamber B to vary by reason of something other than transfer of the hydraulic oil as a consequence of normal operation of the lash adjuster 1. This change adversely affects the operation of the lash adjuster 1.

To solve this problem in the prior art, the applicant of the present invention previously proposed shielding the outer surface of the diaphragm 5 from the atmosphere by incorporating it in a sealed space and by filling the space with engine oil when the lash adjuster 1 is incorporated in the internal combustion engine.

The present invention is designed for overcoming the following problem which was left unsolved in the above-described proposal made by the present applicant.

Although this proposed valve train or system made it possible to prevent the atmospheric air from permeating into the reservoir chamber B, the volume of the reservoir chamber B varied slightly at elevated temperatures as occurred in the lash adjuster when the internal combustion engine is running.

The present applicant therefore performed gas chromatography on hydraulic oil and engine oil to obtain the molecular weight distribution thereof. In so doing, applicant found out, on the basis of the measurement results obtained, that the volume in the reservoir chamber B changes because:

(1) when the compositions of the engine oil X and the hydraulic oil Y that are respectively in contact with the outer and inner surfaces of the diaphragm 5 formed of silicone rubber, they have different molecular weight distribution patterns (FIG. 2 shows the measurement results by gas chromatography. By replacing the unit of the axis of abscissa of the graph from time to molecular weight distribution, curves X & Y represent the molecular weight distribution patterns). Osmotic pressure thus develops across the diaphragm 5, so that the low molecular weight component of the oil having a larger proportion of low molecular weight components permeates through the diaphragm into the oil having a smaller proportion of low molecular weight components (from the hydraulic oil Y into the engine oil X in the given example), and (2) the composition of the diaphragm 5 has a strong intermolecular bond at a normal temperature and the intermolecular distance thereof is small as shown in FIG. 3 (A). As a result, permeation of the low molecular weight component is restricted. The intermolecular bond of the composition of the diaphragm 5 becomes loose as the temperature of the diaphgragm 5 increases due to the heat transferred from the engine, and the distance between molecules thus tends to be expanded, as shown in FIG. 3 (B), thereby accelerating the permeation of the low molecular weight component.

Consideration has therefore been given to employing an engine oil and a hydraulic oil which are respectively in contact with the outer and inner surfaces of the diaphragm 5 which have substantially the same molecular weight distribution, and this has made it possible for changes in the volume of the reservoir chamber B to be kept small.

In normal operation of an internal combustion engine, however, the engine oil employed is not always one which has the same molecular weight distribution as that of the hydraulic oil, and such a case has to be taken into consideration.

INVENTIVE MEANS FOR SOLVING THE PROBLEM

This invention has been developed for the purpose of obviating the above noted disadvantage. Accordingly, an object of the present invention is to provide a sealed-type lash adjuster which is characterized in that a diaphragm is mounted between the open end of a body and a plunger so as to form a reservoir chamber for a hydraulic oil to be supplied to a high pressure chamber. This high pressure chamber is formed between the inner surface of a bottom portion of the body and the plunge. The diaphragm is formed of a flexible material, with at least part of the thickness of the diaphragm being formed of a fluorine bonded layer extending over the entire surface thereof. In one embodiment of the present invention, the diaphragm is formed by fluororubber, so that the fluorine bonded layer forms the entire thickness of the diaphragm.

In the sealed-type lash adjuster according to the present invention, a fluorine bonded layer is formed in the diaphragm. In consequence, the intermolecular bond of the diaphragm compositions is made to be stronger, and the degree of movement of the molecules thereof at elevated temperatures is reduced. It is therefore possible to restrict the permeation of hydraulic oil or engine oil components through the diaphragm.

DRAWINGS

In the appended drawings

FIG. 2 shows the results of molecular weight distribution measurements by gas chromatography conducted on a hydraulic oil and an engine oil;

Figure 5:
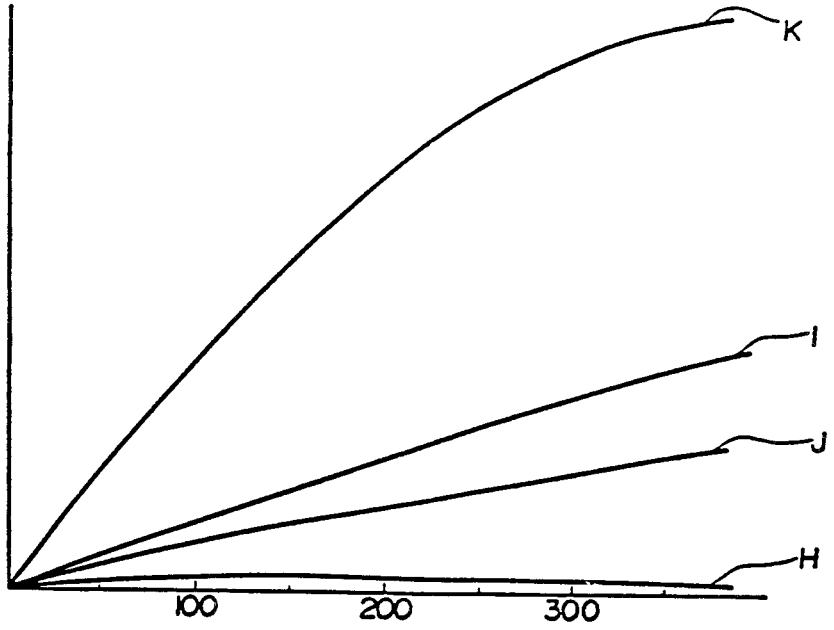
Figure 4:
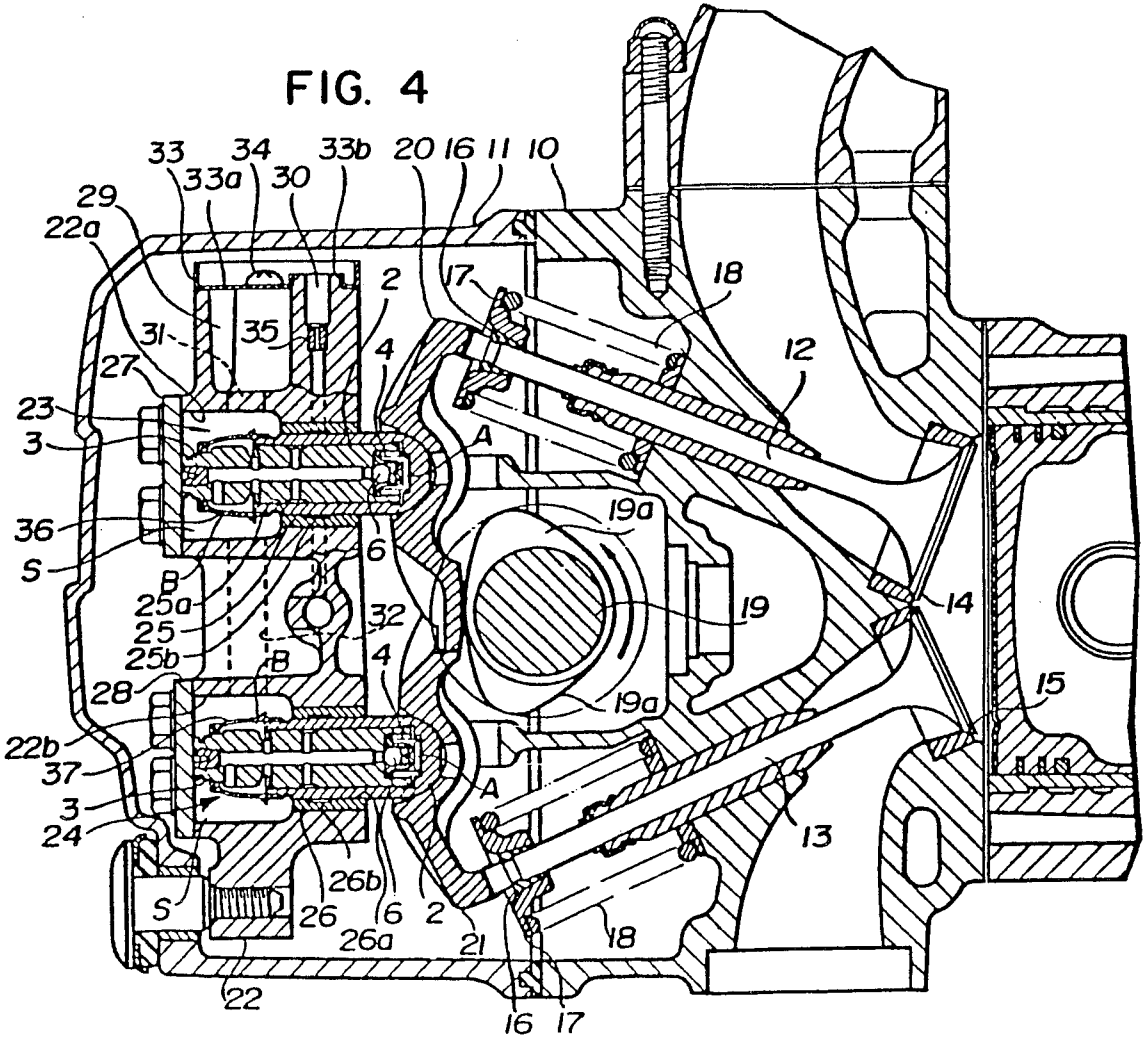

FIGS. 3 (A) and (B) schematically illustrate the mechanism of the permeation of the components of hydraulic oil and engine oil through a diaphragm;

FIG. 4 is a longitudinal cross-sectional view of an internal combustion engine having a valve mechanism to which an embodiment of the present invention is applied; and FIG. 5 is a graph of the variation in volume of the reservoir chamber in the sealed-type lash adjuster according to the present invention, and that of the prior art, which occurs when the lash adjuster is operated at elevated temperatures.

To facilitate the ensuing discussion, the following reference numeral designations will be applied:

2 . . . body,
3 . . . plunger,
4 . . . plunger spring,
6 . . . check valve,
12 . . . suction valve,
13 . . . exhaust valve,
19 . . . cam shaft,
20,21 . . . rocker arms,
22 . . . holder,
23, 24 . . . sealed-type lash adjusters,
36,37 . . . diaphragms,
A . . . high pressure chamber,
B . . . reservoir chamber,
S . . . sealed space

PREFERRED EMBODIMENT

An embodiment of the present invention will be described in detail below by referring to FIG. 4.

FIG. 4 shows a cylinder head portion of an internal combustion engine which incorporates therein a valve mechanism having a sealed-type lash adjuster of this embodiment, the valve mechanism being generally described below.

The valve mechanism is incorporated in a space defined between a cylinder head 10 and a head cover 11 secured thereto. It includes a suction valve 12 and an exhaust valve 13 slidably mounted in the cylinder head 10. Vales 12 and 13, respectively, are adapted to open or close a suction port 14 and an exhaust port 15 formed in the cylinder head 10 by respective reciprocation of the suction valve 12 and the exhaust valve 13 in their longitudinal directions.

The suction valve 12 and the exhaust valve 13 are made to protrude into the defined space noted above. Each of the valves has a retainer 17 mounted onto the projecting end thereof by the wedging action of a divided cotter 16. A valve spring 18 extends between the retainer 17 and the cylinder head 10, by means of which the valve 12 or 13 is constantly urged in the direction in which it closes the associated port, and against the resilient force of which it is intermittently moved to an open position.

The valve train further includes a cam shaft 19 rotatably mounted in the cylinder head 10 between the two valves 12, 13 and having a plurality of cams 19*a* formed as units thereof. Rocker arms 20, 21 extend between the cam shaft 19 and the protruded ends of the respective valves 12, 13 in such a manner as to be freely rockable. A holder 22 of aluminum alloy is secured to the cylinder head 10 separately from and in a mutually opposed relationship with respect to the rocker arms 20, 21. Sealed-type lash adjusters 23, 24 according to the present invention, are slidably mounted on the holder 22. The rocking centers of the rocker arms 20, 21, respectively, are pivotally engaged with the lash adjusters 23 and 24 as shown in FIG. 4.

Bushings 25, 26 extending substantially in the horizontal direction (in the longitudinal direction in FIG. 4), are mounted on the holder 22 by, for example, press fitting, so as to form guiding holes 25*a*, 26*a*. Into these holes the sealed-type lash adjusters 23, 24, respectively, are received. Recesses 22*a*, 22*b*, which respectively communicate with the guiding holes 25*a*, 26*a*, are formed on the side of the holder which is opposite to that which faces the rocker arms 20, 21, so that they form sealed spaces S when closed by lid bodies 27, 28, respectively.

The upper portion of the holder 22 (i.e., the upper portion of FIG. 4) is provided with an upward-opening oil reservoir 29. An oil supply aperture 30 in holder 22 extends substantially in the vertical direction (in the lateral direction of FIG. 4). The oil reservoir 29 communicates with the recesses 22*a*, 22*b* via passages 31, 32 respectively, while the oil supply aperture 30 communicates with peripheral grooves 25, 26 formed on the inner peripheral surfaces of the bushes 25, 26, respectively. In this way, engine oil splashed up by the cam shaft 19 or the other moving members is supplied into the sealed spaces S and to the inner peripheral surfaces of the bushes 25, 26 on which the sealed-type lash adjusters 23, 24, respectively, slide.

The upper portion of the holder 22 is also provided with an oil receptable 33 mounted thereon by means of a bolt 34 in such a manner that it covers the opening of the oil reservoir 29. This oil receptacle may be formed by, for example, press forming a thin metal plate. Receptacle 33 has holes 33*a*, 33*b* connected to the oil reservoir 29 and the oil supply aperture 30, respectively, and through which the received engine oil is introduced thereto.

The oil supply aperture 30 incorporates an orifice 35 by which the amount of oil supplied to the inner peripheral surfaces of the bushes 25, 26 is adjusted or controlled.

Figure 1:
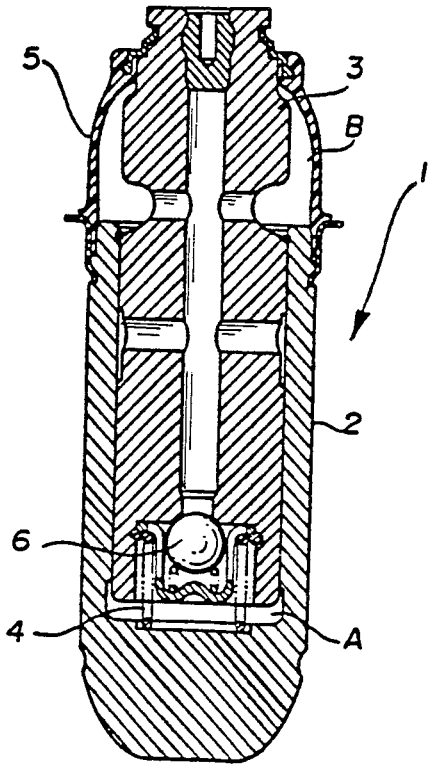
FIG. 1 is a longitudinal, cross-sectional view of an embodiment of a sealed-type lash adjuster.

The sealed-type lash adjusters 23, 24, according to the present invention, each have the same structure as that of the known lash adjuster shown in FIG. 1. Each of the lash adjusters is supported by the holder 22 in a state wherein the body 2 thereof is slidably received in the corresponding guiding hole 25*a* or 26*a*. The protruding end of the plunger 3 and the diaphragm 36 or 37 forming the reservoir chamber B are both incorporated in the recess 22*a* or 22*b*, while the protruding end of the plunger 3 abuts against the lid body 27 or 28. The spherical outer surface of the bottom portion of the body 2 engages with the rocking center of the rocker arm 20 or 21 so as to pivotally support the same.

The sealed-type lash adjusters 23, 24 according to the present invention each have a diaphragm 36 or 37 formed of a flexible material, and at least part of the thickness thereof is formed of a fluorine bonded, i.e. fluorinated, layer which extends over the entire surface thereof.

More specifically, the diaphragm 36 or 37 of the lash adjuster of this embodiment is formed of a fluororubber (such as FKM, FFKM), so that the fluorine bonded layer forms the entire thickness and extends over the entire surface of the diaphgragm.

The interior of the thus-arranged sealed-type lash adjuster of this embodiment was charged with a mineral oil which had a molecular weight distribution pattern ranged from low molecular weight to high molecular weight and which had a peak molecular weight of 400 to 500, as hydraulic oil. The recesses 22*a*, 22*b* of the holder were filled with a synthetic oil having a substantially uniform molecular weight, such as engine oil. The diaphragms 36, 37 of the sealed-type lash adjusters 23, 24 were immersed into the latter oil. When the temperature of the sealed-type lash adjusters 23, 24 in this state was raised to and kept at about 135° C., the volume of the reservoir chamber B remained substantially the same, as shown by curve H in FIG. 5. The surface area of the diaphragm 36, 37 at this time was 5 cm 2. and the amount of hydraulic oil contained in the reservoir chamber B was 1 cc.

It is thought that changes in the volume of the reservoir chamber B are restricted because the intermolecular distance is smaller than that of the composition of the base material, owing to the bonding of fluorine in the flurorubber with the components of the base material, thereby increasing the bonding strength and keeping it high at elevated temperatures, and because the intermolecular distance is therefore kept small enough not to allow the components of the hydraulic oil or engine oil to permeate therethrough.

In consequence, in the sealed-type lash adjusters 23, 24 of this embodiment, it is possible to prevent changes in the volume in the reservoir chamber B and maintain its operating characteristics, even if the engine oil used has a different molecular weight distribution pattern from that of the hydraulic oil.

The sealed-type lash adjuster of the present invention was described above by way of example. Modifications and changes are therefore possible in accordance with the type of engine or the valve train to which it is applied.

For example, the diaphragm material may alternatively be formed by fluorinating a base material of intrile rubber (NBR) or hydrogenated nitrile rubber (HNBR) in fluorine gas so as to form a fluorine treated, coating layer of a predetermined depth on the front and rear surface of the base material (or on only the front or rear surface thereof). It may also be fluorinated silicone rubber or fluorinated silicone rubber formed with a fluorine coating layer.

A diaphragm formed of the former material enables production costs to be reduced when it is applied to a sealed-type lash adjuster employed in an engine or a valve mechanism in which the quantity of heat transferred to the lash adjuster is small. With a diaphragm formed of the latter material, durability and characteristics can be maintained when the lash adjuster is operated at low temperatures.

The characteristics of lash adjusters employing typical examples of the latter two types of diaphragm were checked, and the results shown by curves I and J in FIG. 5 were obtained, the curve I showing the characteristics of a lash adjuster employing a diaphragm of fluorinated silicone rubber and the curve J showing those of a lash adjuster employing a fluorinated silicone rubber diaphragm with a fluorine coating layer. In these cases, changes in the volume of the reservoir chamber B were decreased to below half those of a hydrogenated nitrile rubber diaphragm having no fluorine bonded layer, shown by curve K in FIG. 5, although they were larger than those of a lash adjuster employing a fluororubber diaphragm.

As will be seen from the foregoing description, the sealed-type lash adjuster according to the present invention comprises a cylindrical body having a bottom, a plunger slidably received in the body and forming a high pressure chamber between the inner surface of the bottom portion of the body and the plunger, so as to seal in hydraulic oil, and a diaphragm mounted between the open end of the body and the plunger and forming a reservoir chamber for the hydraulic oil to be supplied to the high pressure chamber. The invention is characterized in that the diaphragm is formed of a flexible material and that at least part of the thickness of the diaphragm is formed of a fluorine bonded layer extending over the entire surface thereof. In one embodiment of the present invention, the diaphragm is formed of flurorubber, so that the fluorine bonded layer forms the entire thickness of the diaphragm. In consequence, even if the diaphragm is immersed in engine oil of a different molecular weight distribution from that of the hydraulic oil filling the lash adjuster, permeation of the components of the hydraulic oil and engine oil through the diaphragm can be prevented, and variations in the volume of the reservoir chamber can therefore be prevented. Permeation can be restricted even at elevated temperatures, so that the operation characteristics can be maintained. Further, the present invention makes it possible to employ any type of engine oil, while maintaining the characteristics thereof.

With the invention now having been thus described, those skilled in the engine art and familiar with this disclosure may well recognize additions, deletions, substitutions or other modifications or equivalents which would fall within the scope of the invention as hereinafter claimed.

What is claimed is:

1. A sealed-type lash adjuster comprising:

cylindrical body means having a bottom;

plunger means slidably received in said body means and forming a high pressure chamber for sealing hydraulic oil between an inner surface of said bottom portion of said body means and said plunger means;

diaphragm means mounted between an open end of said body means and said plunger means and forming a reservoir chamber for the hydraulic oil to be supplied to said high pressure chamber, said diaphragm means being formed of flexible material, with at least part of the thickness thereof being formed of a fluorine-bonded layer extending over the entirety of said diaphragm means;

holder means including bushing means, including an interior surface having an annular channel therein, for slideably receiving said cylindrical body means with said bottom portion of said body means generally facing toward a combustion chamber means and engageable with valve rocker means, and said diaphragm means and said open end of said body means generally facing away from said combustion chamber means;

fluid reservoir means for storing fluid lubricant; and conduit means in fluid communication with said fluid reservoir means and said annular channel in said bushing means, for conducting fluid lubricant from said fluid reservoir means to said annular channel in said bushing means; and mounting means operable to secure said holder means with said cylindrical body means being interposed between said combustion chamber means and said diaphragm means.

* * * * *